United States Patent [19]

Philipp

[11] 4,060,031

[45] Nov. 29, 1977

[54] PRINTING METHOD AND APPARATUS FOR PERFORMING THE PRINTING METHOD

[76] Inventor: Wilfried Philipp, Daimlerstrasse 27/1, 7254 Munchingen-Kallenberg, Germany

[21] Appl. No.: 406,901

[22] Filed: Oct. 16, 1973

Related U.S. Application Data

[63] Continuation of Ser. No. 59,056, July 29, 1970, abandoned.

[30] Foreign Application Priority Data

Aug. 2, 1969 Germany ..... 1939437

[51] Int. Cl.[2] ..... B41F 17/00; B41M 1/14

[52] U.S. Cl. ..... 101/163; 101/41; 156/240

[58] Field of Search ..... 101/426, 150, 163–170, 101/195, 395, 41, 401.1; 29/132; 156/240

[56] References Cited

U.S. PATENT DOCUMENTS

| | | | |
|---|---|---|---|
| 640,041 | 12/1899 | Sproule | 101/166 |
| 1,599,918 | 9/1926 | O'Hara | 101/41 |
| 2,662,471 | 12/1953 | Gillis | 101/164 |
| 2,781,278 | 2/1957 | Harmon | 101/395 |
| 3,146,144 | 8/1964 | Lemelson | 101/426 X |
| 3,225,419 | 12/1965 | Milton | 29/132 |
| 3,255,695 | 6/1966 | Johnson et al. | 101/211 |
| 3,456,586 | 7/1969 | Andrus | 101/401.1 |
| 3,554,836 | 1/1971 | Steindorf | 101/426 X |
| 3,688,695 | 2/1970 | James | 101/211 |
| 3,701,317 | 12/1972 | Miyamoto | 101/170 |

FOREIGN PATENT DOCUMENTS

| | | | |
|---|---|---|---|
| 1,139,129 | 11/1962 | Germany | 101/150 |
| 1,004,237 | 9/1965 | United Kingdom | 101/395 |
| 946,028 | 1/1964 | United Kingdom | 101/195 |
| 854,119 | 11/1960 | United Kingdom | 101/395 |

*Primary Examiner*—E. H. Eickholt
*Attorney, Agent, or Firm*—Craig & Antonelli

[57] ABSTRACT

Method and apparatus for printing materials, wherein ink is applied to an intaglio matrix and then scraped off to such an extent that ink remains only in the depressions of the matrix. A printing pad having a surface which is normally repellent to ink is pressed onto the matrix such that ink adheres thereto in accordance with the pattern of the depressions of the matrix. The printing pad is then pressed against a material to be printed such that the ink on the printing pad is substantially completely transferred to the printed material.

19 Claims, 13 Drawing Figures

Figure 1:
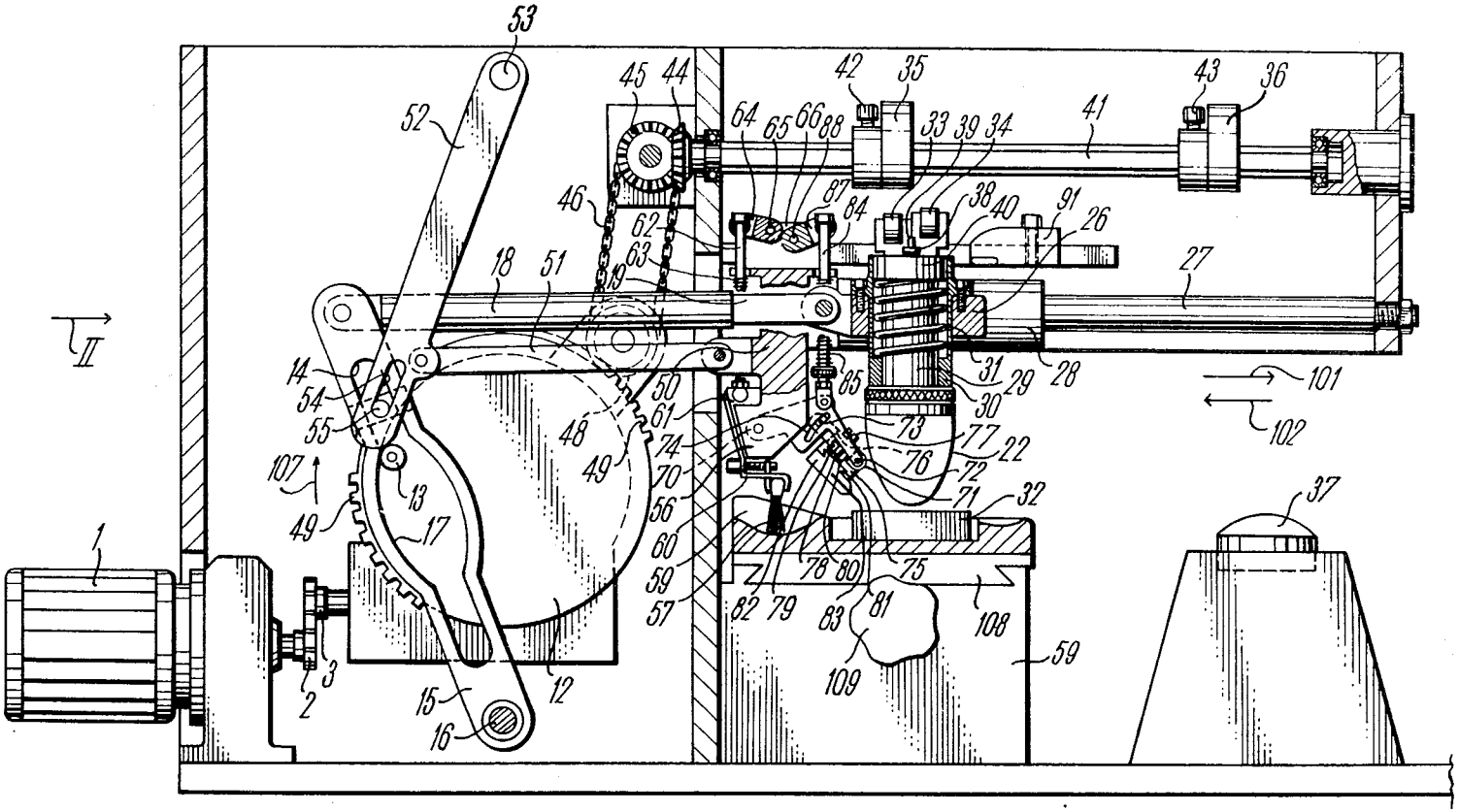

INVENTOR
WILFRIED PHILIPP

BY Craig, Antonelli, Stewart & Hill
ATTORNEYS

INVENTOR
WILFRIED PHILIPP

BY Craig, Antonelli, Stewart & Hill
ATTORNEYS

INVENTOR

WILFRIED PHILIPP

BY Craig, Antonelli, Stewart & Hill

ATTORNEYS

INVENTOR

WILFRIED PHILIPP

BY Craig, Antonelli, Stewart & Hill

ATTORNEYS

PRINTING METHOD AND APPARATUS FOR PERFORMING THE PRINTING METHOD

This is a Continuation Application of Serial No. 59,056 filed July 29, 1970 now abandoned which is incorporated by reference herein.

The invention relates to a method of printing metals, ceramic, glass and other materials, wherein an intaglio metal matrix, such as a steel matrix provided with a negative etching, is inked and the ink is scraped off to such extent that the ink remains only in the intaglio depressions or etched grooves, and wherein a printing pad is then pressed upon the matrix and the ink which is taken up by the printing pad from the matrix is transferred by means of the printing pad upon a print carrier, this method of indirect printing with a printing pad being also referred to as tampon method.

This tampon method is used inter alia where it is necessary to imprint curved surfaces and also such surfaces on which fine lines must be printed in close proximity. The known method, however, is performed only manually and a printing pad is used therein which consists of gelatine. The use of a gelatine printing pad has the particular disadvantage that although gelatine absorbs the major part of the ink which it has removed from the etched lines, not all of it is given up again so that in time too much ink remains adhering to the printing pad. For this reason a printing pad of gelatine has to be cleaned at least after each tenth print. A further disadvantage is that the quality of gelatine printing pads is dependent upon atmospheric humidity and therefore the printing pads must be changed in dependence upon the climatic conditions.

It is an object of the invention to avoid these disadvantages. The problem is solved according to the invention, in that a printing pad is used which rejects the ink to such extent that it just accepts the ink when pressed upon the matrix, but delivers it substantially completely when it is pressed upon the support to be imprinted.

Thus, a printing pad with a substantially nonwetting surface is used whereby the particular advantage is obtained that the printing pad need not be cleaned because it delivers the ink completely. This is extremely important because when the method is performed by machine it is impossible to clean the printing pad after each print or after each tenth print, as would be necessary in the case of gelatine printing pads in which the printing ink is slightly absorbed by the surface. Moreover, cleaning of the printing pads is impossible in machine printing because the ink in the matrix would dry out during the cleaning procedure.

A material which fulfills the required conditions in an almost ideal manner is in accordance with one embodiment of the invention a printing pad of silicone rubber. Although the silicone rubber is wetted by the printing ink, the surface of the silicone rubber, however, delivers the ink completely in an ideal manner during printing because it has a repelling effect for nearly all chemicals. The property that the printing pad delivers all of the ink can be obtained also by other materials if certain defined inks are used. The advantage of the silicone rubber, however, is that substantially all usable inks, in particular also quick drying inks, are given up without leaving ink residues on its surface during printing. A further advantage consists in that in the transfer of a line etching by means of a silicone rubber printing pad the so-called "shadows" are avoided which are frequently also transferred when a gelatine printing pad is used. Thus, a "shadow free" print is obtained in an advantageous manner. In contrast to silicone rubber, gelatine also accepts very small quantities of ink. By the use of a silicone rubber printing pad a good print is therefore obtained in an advantageous manner even if the matrix is not scraped quite so clean as is necessary in other printing methods.

Although silicone rubber transfer members are known in the printing field, such members have not been utilized for tampon printing and have generally required the direct application of heat to the transfer member or the ink utilized therewith in order to effect substantially complete image transfer. That is, the silicone rubber as utilized in prior art printing arrangements did not possess an ink-repellant or nonwetting characteristic as the silicone rubber printing pad of the present invention, thereby requiring the application of heat or temperature controls to effect complete image transfer. However, in accordance with the present invention, substantially complete image transfer is effected by the silicone rubber pad without the requirement of applying heat directly to the pad or the ink or the maintenance of a narrow critical temperature control range for proper operation.

In order that curved bodies can also be printed by the method according to the invention, an elastomeric silicone rubber having high resiliency is used in a further embodiment of the invention. This has the advantage that the printing pad yields to a high degree under compression and thus can neither burst nor tear when the ink is received from the matrix and when the ink is delivered to the print carrier.

In the method according to the invention screen printing inks having a cellulose base or a synthetic resin base as well as stoving inks can be used.

In one embodiment of the invention the printing pad is pressed upon the matrix and upon the print carrier with a pressure of approximately 3 (kiloponds) kp/cm$^2$. It is attained thereby that the ink is taken up in a satisfactory manner and is delivered again to a curved surface in a satisfactory manner.

Furthermore, the invention relates to apparatus for performing the method, comprising a table for an ink container, a matrix and a print carrier, a brush for inking the matrix, a doctor blade and at least one printing pad.

Heretofore the known so-called tampon printing method was performed only manually. In this case in dependence upon the depth of the etching and the ink consistency used, the matrix had to be inked again after two, three or four printing processes because the ink stored in the etched lines was exhausted. In particular when printing manually, only such inks could be used which dry very slowly because otherwise the ink dries in the matrix during the printing process. In particular, inks used for screen printing could not be used for transfer to the print carriers in the tampon method.

It is an object of the invention to avoid these disadvantages and to provide apparatus which operates quickly and regularly. The problem is solved according to the invention in that the printing pad attached to the plunger is arranged to be displaceable between the matrix and the print carrier which is disposed at a spacing therefrom, that the printing pad is adapted to be pressed upon the matrix and the print carrier during its rest positions above the matrix and the print carrier, that the brush and the doctor blade are displaceably disposed above the matrix and are adapted to be moved into engagement with the matrix, and that the movements of these parts are derived from a common drive.

In this manner even quick drying inks and substantially all screen printing inks can be used because the machine can operate quickly and in a sequential manner.

The screen printing inks have the particular advantage that materials of various kinds can be printed with them because they adhere to the surfaces of most of the usual materials. It is therefore extremely advantageous if screen printing inks can be used. When quick drying inks are used any residue which remains on the surface of the matrix after wiping is not transferred. Such residues consist mainly of an extremely thin ink layer which, when fast drying inks are used, has dried to such extent in the period between the application of the ink to the matrix and the contact of the printing pad with the matrix that it is no longer accepted by the printing pad. The use of a common mechanical drive for moving the printing pad, the brush and the doctor blade has the advantage that no additional electrical control device is necessary for moving these parts in the correct sequence, which in turn would make it necessary to actuate electrical contacts whereby additional sources of disturbances would possible be introduced into the apparatus according to the invention.

In one embodiment of the apparatus according to the invention the printing pad and/or the brush and the doctor blade are disposed on two carriages both of which are mounted one behind the other on guide bars. Thereby the carriage of the printing pad as well as the carriage of the brush and the doctor blade can be guided on common guide bars in a simple manner.

In one embodiment of the invention the movement of the carriage is derived from a disc driven by a motor. In order to avoid complicated gearing and to simplify the transmission of the movement from the disc to the carriage the disc is provided at one point of its periphery with a roller which engages in a guide means of a lever which is pivotally mounted on a pin rigidly attached to the apparatus casing. The carriages are linked to this lever by means of pivotally connected rods.

In one embodiment of the invention the guide means of the lever is constructed at each of its end as a guide slot and comprises in the region of its center an enlargement or bulge the lateral curved edges of which form a cam section along which the roller of the disc moves. The result is attained in this manner that during the interval of time in which the printing pad is pressed upon the matrix or the print carrier, in which therefore no displacement movement of the carriage of the print carrier must occur, the lever stands still, but the whole drive including the disc can continue running. Thereby special devices, such as for example a coupling device or a control device, are avoided which serve for momemtarily stopping the disc or other driving parts during the dwell periods of the printing pad on the matrix and on the print carrier. The construction of the apparatus according to the invention is extremely simplified thereby.

In an embodiment of the invention the rod connected to the printing pad carriage is displaceably mounted at a sleeve which is pivotally connected to the end of the lever remote from the pin and is connected to the sleeve by means of a compression spring and a tension spring providing a resilient connection between the sleeve and the rod. Because of these springs the connection between the sleeve and the rod is resilient. This resilient connection is provided for the purpose of transforming a stroke caused by the driving disc in cooperation with the pivotally mounted lever connected thereto into a stroke which is perfomed by the printing pad. The path of the printing pad can therefore be shorter than the stroke predetermined by the lever, and the stroke length of the printing pad in the axial direction of the sleeve can be varied within certain limits, for example by adjusting screws serving as stops for the printing pad carriage, without need for adjusting the pivotal movement of the lever or the junction between the lever and the rod or sleeve.

In order that the carriage supporting the brush and the doctor blade is moved only a short period after the printing pad carriage and the latter need be displaced only by a stroke the length of which corresponds to the distance between the ink container and the matrix disposed one behind the other, the rod connected to this carriage may be pivotally connected to an arm which is pivotal about a pin attached to the apparatus casing and which comprises a slotted guide means which is located at its end remote from the pin and which engages a pin disposed on the lever. This arrangement has the advantage that it is particularly simple and can be arranged in a space saving manner.

In am embodiment of the invention the stoke movement of the printing pad is derived from the disc. The printing pad is disposed in this case on a spring loaded plunger and the stroke movement of the printing pad is derived from cam discs driven by the disc. It is attained in this manner that the printing pad performs a stroke movement due to which the pressure of the printing pad on the matrix and on the print carrier increases slowly, attains its highest value and then decreases again. The cam discs from which the movement of the printing pad towards the matrix and towards the print carrier is derived may have different forms so that these two motions may be different. In particular in embodiments of the invention differently shaped cam discs may be associated with the machine so that the motions towards the matrix and towards the print carrier can be adjusted to meet particular requirement. For example, the cam disc for driving the printing pad in the direction towards the print carrier may have such shape that the printing pad rests a relatively long period of time on the print carrier, so that for example the ink is transferred very completely from the printing pad to the print carrier. In this case, the cam disc comprises a circular arc segment, or a segment closely approaching a circular arc, at the point which is travelled through at the lower dead point of the stroke movement. The segment may differ considerably, for example from the circular arc segment, when the printing pad must rest on the print carrier for only a short period of time. The periods during which the printing pad rests on the matrix can be regulated in a similar manner by the shape of the cam disc for driving the printing pad in the direction of the matrix. The period in which the pad contacts the matrix can be adjusted in accordance with the characteristics of the pad, matrix and ink used to ensure that the correct quantity of ink is taken up by a printing pad having a given surface character and cooperating with a certain ink consistency and a predetermined engraving depth of the matrix.

In order to avoid wear and fatigue a plunger supporting the printing pad is provided at its end cooperating with the cam discs with at least one roller, preferably however two rollers, one roller for cooperation with the one cam disc and a second roller for cooperation with the other cam disc, so that each of the two rollers can be constructed to be adjusted independently one of the other.

In a preferred embodiment of the invention the spacing of the roller from the printing pad and therefore the effective length of the plunger is adjustable so that, since the printing pad is resilient, the dwell period of the printing pad on the matrix and on the print carrier and the pressure with which the printing pad rests on the matrix and on the print carrier can be adjusted by adjustment of the effective plunger length. Thereby the apparatus according to the invention can be used for nearly and desirable depth of etching of the matrix and for any print carrier material.

In a further embodiment of the invention the disc is provided with two toothed segments disposed diametrically opposite each other into which engages a gear wheel, which is in operative connection with the cam discs, while the roller of the disc rolls along the enlargement of the guide means of the lever. Thereby the result is attained with simple means that the printing pad performs a motion directed towards the matrix and the print carrier only as long as the lever cooperating with the disc is at rest in either of its two end positions and thus also the carriage is at rest in its end positions.

In an embodiment of the invention the brush is arranged at a spring loaded tie rod which is guided in the carriage and which can be moved into engagement with a stationary cam member disposed at the movement reversal point. The cam member is adjustable in this case in the direction of movement of the carriage in order that the motion of the brush can be adjusted to suit any desirable matrix size.

The movement of the tie rod is derived in a simple manner from the cam member by the fact that the tie rod is pivotally attached to an arm which is pivotally attached to the carriage and the movement of which is derived from a second arm which comprises a roller which cooperates with the cam member.

In a preferred embodiment of the invention the cam member has a cam surface which is disposed in the path travelled through by the roller during the forward movement of the carriage and which lifts the roller. The cam member is provided in this case with a second guide surface which is disposed in the path travelled through by the roller during the return movement of the carraige and which deflects the roller downwardly out of the region of the cam surface. Thereby, the brush is lifted at the end of its movement during which it brushes over the matrix, is moved further a short distance in the same direction, is lowered and carefully deposited on the matrix, and is moved back in the opposite direction. Thereby the accumulation of ink which is pushed forward by the front of the brush remains on the matrix or in a groove disposed therebeyond. During its return movement the brush considered in the direction of movement engages behind the ridge or accumulation of ink and brushes the excess ink back into the ink container.

In an embodiment of the invention, the doctor blade is disposed on a spring loaded tie rod which is guided in the carriage and which cooperates with stationary cam surfaces disposed at the movement reversal points. The cam surfaces are adjustable in this case in the direction of movement of the carriage so that the lifting and lowering of the doctor blade may be effected dependently upon the magnitude of the matrix. The tie rod associated with the doctor blade is also pivotally connected in this case to an arm which is pivotally attached to the carriage and the movement of which is derived from a second arm which comprises a roller cooperating with the cam surfaces.

In order that the doctor blade slides over the matrix only after the brush has deposited ink on the matrix, i.e. therefore only in one direction of movement, a further embodiment of the invention provides that the arm carrying the roller is associated with a detent device which is disposed on the carriage and which detains the roller and thus the doctor blade in a raised position. Furthermore, in this case an abutment is disposed in the path of a member which is idly movable in the direction of movement and which releases the detent device in the other direction of movement. So that the detent device can be constructed in a simple mnner, it comprises a lever which is displaceable about a pin against the action of a spring; the end of the lever which is adjacent to the arm supports an intermediate member which is pivotal about a pin against a spring, and the end which is remote from the arm carries a roller in the path of which the stationary abutment in the vicinity of the movement reversal point is disposed. The lever is in close contact with the intermediate member during the pivotal movement in which it releases the detent.

In the embodiments of the ivention described so far, the operative elements cooperating with the matrix and print carrier, i.e. the printing pad, the brush and the doctor blade, cooperating with the matrix and the print carrier are arranged on carriages for reciprocatory movement. In other embodiments of the invention a plurality of printing pads may be attached to a rotary cross-shaped member which is rotated stepwise in the operating rhythm of the apparatus so that this rotary movement causes the printing pad to rest at one time over the matrix and at another time over the print carrier. Also, the other operative elements may be disposed on the same or another rotary cross. Either the whole of the rotary cross performs a stroke movement, or however the individual tools are displaceable on the rotary cross parallel to the direction of the rotary axis of the rotary cross and are individually driven for performing the displacement movement. If this construction is considered to be too elaborate or complex, for example the matrix and the print carrier may be arranged to perform a stroke movement in the direction of the rotary axis of the rotary cross.

These arrangements have the advantage that a plurality or operating points can be connected one behind the other, and for example the arrangements may be made so that a plurality of differently colored color separations can be printed on the print carrier. In the case of two-color prints, alternatively two printing pads may be used which are both disposed on a commonly displaceable member. This member is movable in such manner that each printing pad receives the ink from its matrix while the other printing pad prints the color separation upon the print carrier.

Figure 2:
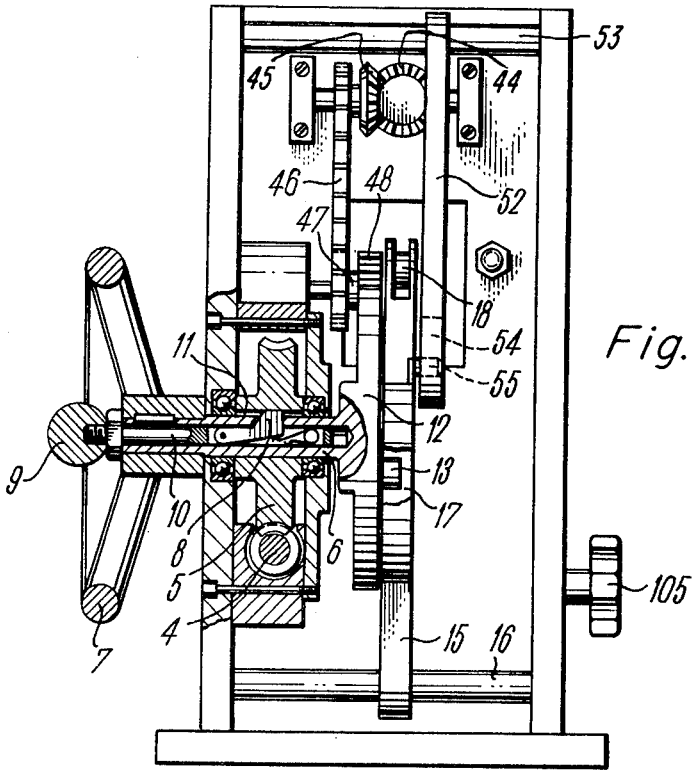
Figure 5A:
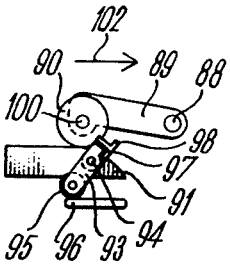
Figure 5B:
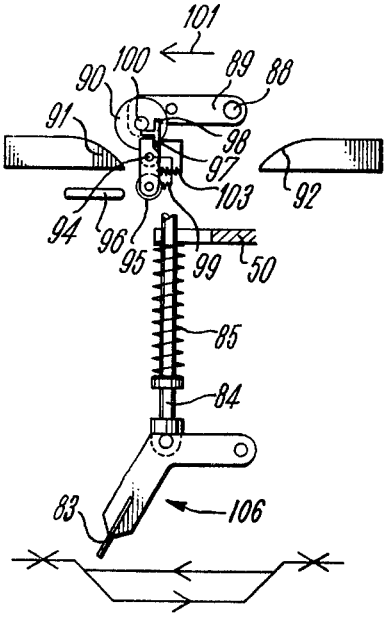
Figure 5C:
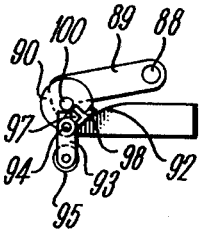
Figures 3, 4A, 4B:
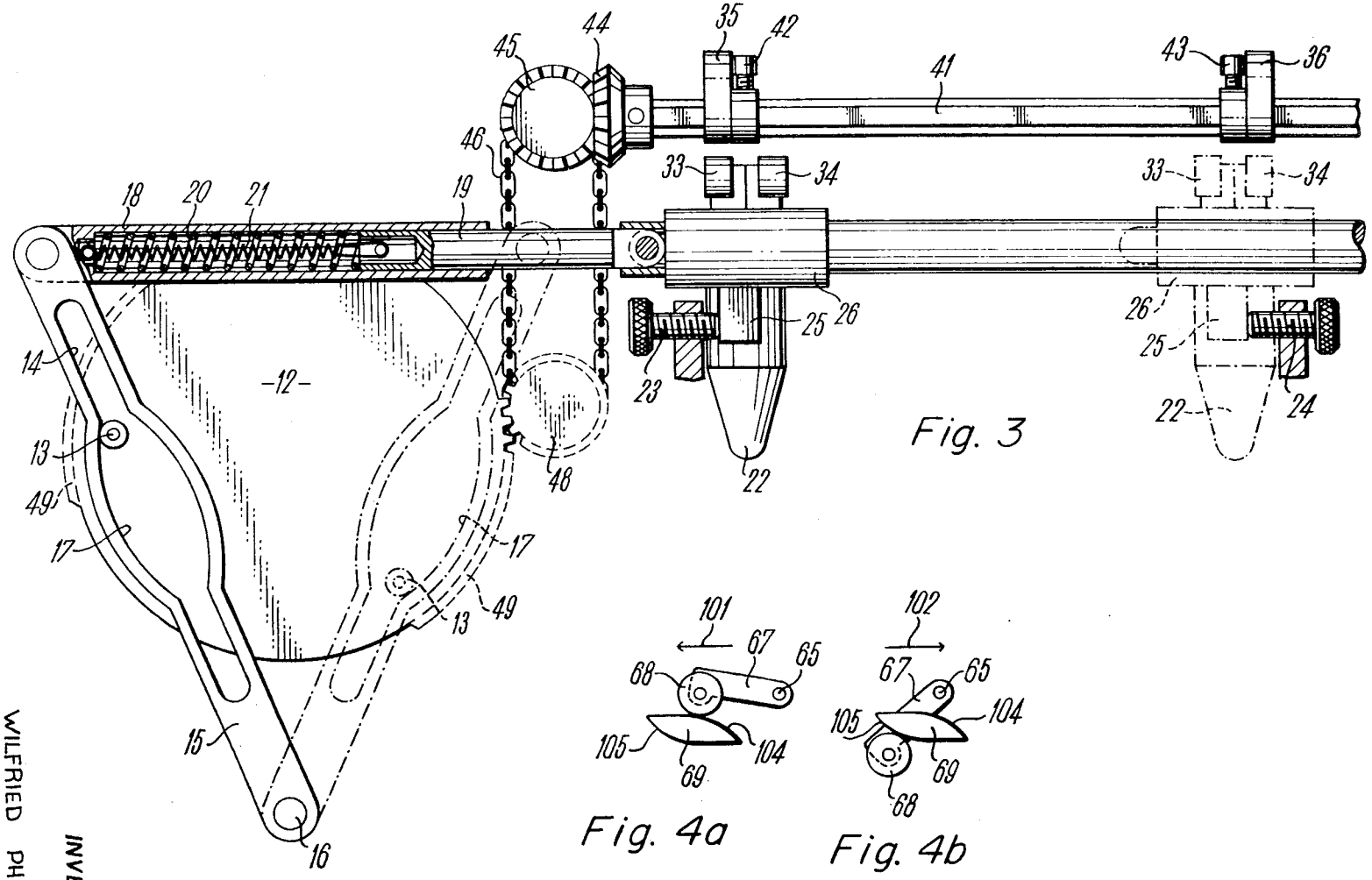
Figure 6A:
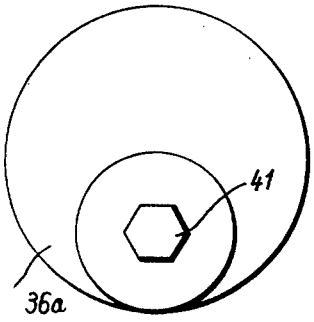
Figure 6B:
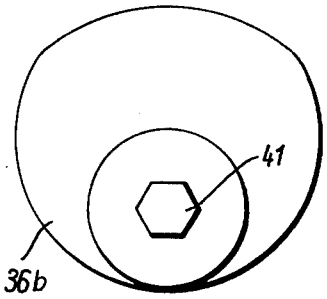
Figure 6C:
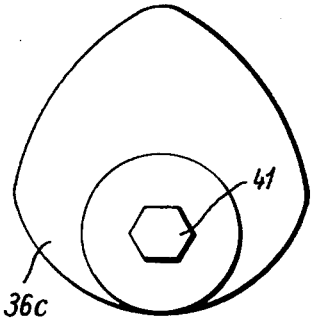
Figure 7:
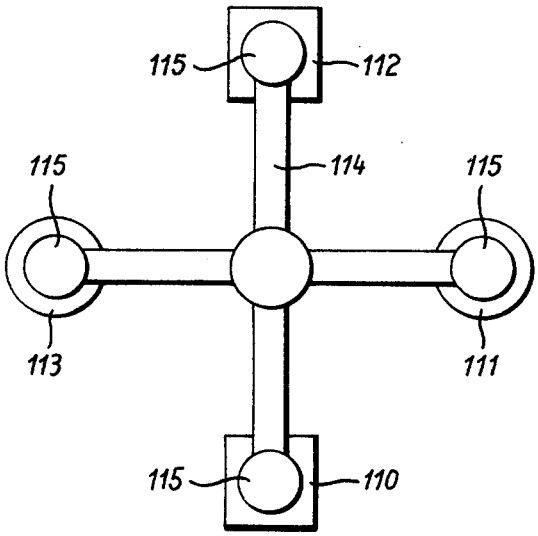
Figure 8:
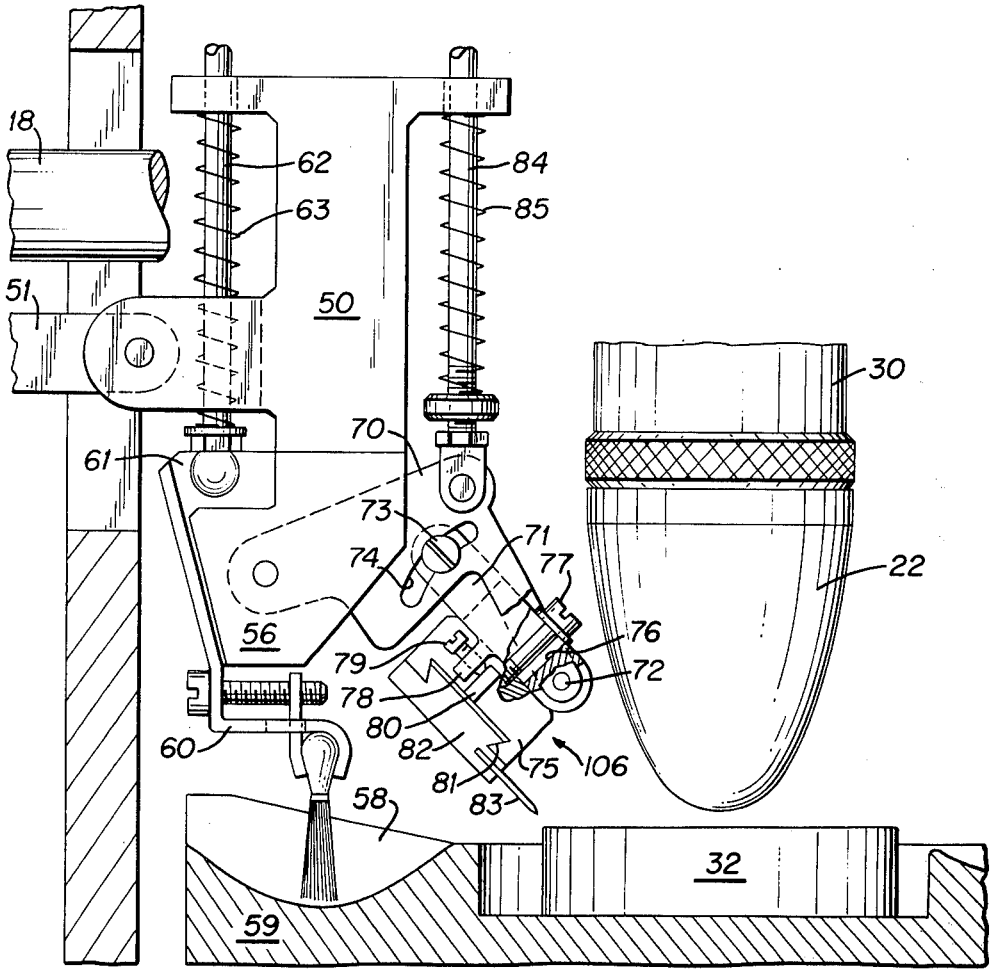

Further features and constructional details of the invention may be taken from the following description in which the invention is described and explained in detail with reference to the constructional examples illustrated in the drawings. The features which may be taken from the description and the drawings may be used in other embodiments of the invention either singly by themselves or several thereof in any combination. In the accompanying drawings:

FIG. 1 is a section through the apparatus according to the invention for performing the method according to the invention, FIG. 2 is a view in the direction of the arrow II of FIG. 1, partly in section, FIG. 3 illustrates the drive mechanism of the apparatus according to the invention on an enlarged scale, FIGS. 4*a* and 4*b* illustrate a cam control as part of the drive system for regulating the motion of the brush of the apparatus according to the invention, FIGS. 5*a*, 5*b* and 5*c* illustrate the control of the movement of the doctor blade of the apparatus according to the invention, FIGS. 6*a*, 6*b* and 6*c* illustrate different embodiments of cam discs for controlling the movement of the printing pad of the apparatus according to the invention, FIG. 7 illustrates diagrammatically a plan view of another embodiment of the invention, and FIG. 8 illustrates the mounting arrangement for the doctor blade of the apparatus according to the invention on an enlarged scale.

As illustrated in FIG. 1 and particularly in FIG. 2, a pinion 3 which is mounted on a worm shaft 4 is driven in the apparatus according to the invention by a motor 1 by means of a chain 2. The motor 1 is constructed as a variable speed motor the range of rotary speed variation and the gear transmission of which corresponds to approximately a range of from 300 to 1500 operating steps per hour. A worm wheel 5 which rolls on the worm shaft 4 is rotatably mounted on a shaft 6 of a hand wheel 7 rigidly connected to the shaft 6 by means of a key and keyway connection, and can be rigidly connected to the shaft 6 by a releasable pawl 8. For this purpose the shaft 6 is constructed as a hollow shaft and comprises a central rod 10 which is provided at its end projecting from the shaft 6 with a release button 9 and the other end of which is pivotally connected to the pawl 8. The pawl 8 engages in the detaining position through an opening of the shaft 6 into a keyway 11 in the opening of the worm wheel 5 and is pressed by a spring into the keyway 11. The shaft 6 of the worm wheel 5 is connected to a driving disc 12 which carries at one point of its periphery a roller 13 which engages into a slot guide 14 of a lever 15. The lever is pivotally mounted on a pin 16 attached to the apparatus casing. The slot guide 14 comprises in the region of its center an enlargement 17 the lateral curved edges of which form a cam section extending around the axis of the driving disc 12 so that the lever 15 is at rest when the roller 13 passes along this section of the slot guide 14. The end of the lever 15 remote from the pin 16 is pivotally connected to a sleeve 18, as illustrated in particular also in FIG. 3, and a rod 19 is mounted in the sleeve displaceable therein against spring action. In the sleeve 18 a compression spring 20 and a tension spring 21 are provided the two together forming a resilient connection between the sleeve 18 and the rod 19. This resilient connection has the purpose to convert the displacement movement provided by the lever 15 in cooperation with the driving disc 12 into a horizontal stroke which is performed by a printing pad 22 between a matrix 32, which may consist for example of steel, and a print carrier 37. The horizontal stroke path of the printing pad 22 disposed on a carriage 26 may therefore be smaller than the stroke determined by the lever 15, and the position of the stroke path of the printing pad 22 can be shifted within certain limits in the axial direction of the sleeve 18. The position of the horizontal stroke path as well as the magnitude of the stroke are adjusted by two adjusting screws 23 and 24 (see FIG. 3) which are disposed on the apparatus casing and which limit the stroke path by abutment against an abutment lip 25 of the carrriage 26.

The carriage 26 is pivotally connected to the rod 19 and is mounted by means of ball bearings 28 on two parallel guide bars 27. A plunger 29 which supports the printing pad 22 is mounted in the carriage 26 and is displaceable perpendicularly to the guide bars 27. The plunger 29 is mounted in a guide member 30 which is attached to the carriage 26 and which supports one end of a spring 31, the other end of which rests against a screw bolt 40 attached to the plunger 29, the spring pressing the plunger 29 into its end position remote from the matrix 32. The plunger 29 supports at its end remote from the printing pad 22 two rollers which are rotatable about an axis which is disposed perpendicularly to the axis of the plunger 29, the spacing of the rollers 33 and 34 from the plunger being individually adjustable. Thereby the effective length of the plunger 29 is adjustable. The adjustment of the rollers 33 and 34 is effected in that each roller is provided with a support having a slot into which engages a collar 38 of a screw 39 which is screwably guided in the screw bolt 40 attached to the plunger 29. The one roller 33 cooperates with a cam disc 35 in the position in which the printing pad 22 is disposed above the matrix 32, and the other roller 34 cooperates with a cam disc 36 in the position in which the printing pad 22 is disposed above the print carrier 37. Since the printing pad 22 is resilient the dwell period of the printing pad on the matrix 32 and on the print carrier 37 and the pressure with which the printing pad 22 rests on the matrix 32 and on the print carrier 37 can be varied by adjusting the effective plunger length, that is to say by adjusting the rollers 33 and 34.

In an embodiment of the invention the period of time for lifting and lowering the printing pad 22 amounts to approximately 0.75 seconds, the dwell period of the printing pad 22 on the matrix 32 amounts to approximately one-tenth of a second and the dwell period of the printing pad 22 on the print carrier 37 amounts also to approximately one-tenth of a second. During this period the plunger 19 to which the printing pad 22 is attached performs a vertical stroke movement derived from the cam discs 35 and 36, respectively, so that the pressure increases slowly, attains its maximum value and decreases again. In an embodiment of the invention in which an intaglio matrix with an engraving depth of 3/100 mm was used, and in which the ink had a consistency of low viscosity, the printing pad which had an ovoid shape was pressed upon the matrix with a pressure of approximately 20 kp. The matrix had a diameter of approximately 15 mm and the area occupied by the printing pad on the matrix has at its lowest point a diameter of approximately 30 mm, so that a specific pressure of approximately 3 kp/cm$^2$ resulted therefrom. In this position the lower end of the printing pad was compressed by approximately 8 mm.

The adjustable pressure range required in dependence upon the characteristic of the printing pad and the print carriers is in the range of approximately 2 to 5 kp/cm$^2$.

The printing pad 22 consists of silicone rubber and is formed from the combination of the casting mass or resin "56" and the hardener "T", or from the combination of the molding mass or resin and the hardener "T" produced by the firm Wacker-Chemie, Munich, Germany. Depending upon the desired resilience of the printing pad which in turn depends on the particular printing problem, either the more resilient molding mass or the slightly harder casting mass "56" is used in the formation of the pad. By the addition of a larger or smaller quantity of hardener "T" which serves simultaneously as accelerating means and as hardening means, additionally the magnitude of the resilience can be modified. The silicone rubber has the property that it just accepts the printing ink when pressed upon the matrix, and delivers the ink substantially completely when it is pressed upon the support to be printed. This silicon rubber used for the printing pad has great resilience so that the printing pad is extremely springy and thus in particular also highly curved bodies can be printed. By the use of the silicone rubber substantially all inks suitable for printing metal, ceramic, glass and the like can be used, in particular also the quick drying inks. Screen printing inks based on synthetic resin were manipulated with a silicone rubber printing pad in accordance with the present invention. However, screen printing inks based on cellulose, and stoving and glazing inks can be used also with the silicone rubber printing pad. In particular, a synthetic resin screen printing ink based on an alkyd resin ink drying by the absorption of oxygen from the air was used for printing in series. In addition to the "Wiecolux synthetic resin ink A" produced by the firm of Wiederhold of Hilden, Germany, the screen printing ink "y", the screen printing ink "K" and "PK" based on cellulose and the stoving ink "O" of this firm, as well as the screen printing inks "Maraplast D" and "Marapol PY" and the stoving ink "Maradue E" produced by Marabuwerke GmbH in Tamm, Wurttemberg, Germany, were used in the method and apparatus of this invention with success.

As illustrated further in FIGS. 1 and 3 the cam discs 35 and 36 each of which comprises a collar are displaceable on a hexagonal shaft 41 and can be fixed thereon by clamping screws 42 and 43 arranged in the collar. The cam discs 35 and 36 are thus interchangeable and as illustrated in detail in FIGS. *6a6c,* may have different shapes. In particular three cam discs are utilized all of which are eccentrically mounted on the hexagonal shaft 41. The cam disc 35 which is disposed in the region opposite the matrix 32 and causes the printing pad 22 to be pressed onto the matrix 32 is substantially always constructed as a normal eccentric disc as illustrated in FIG. *6a,* because most of the matrices 32 have always the same surface character and groove depth, so that also when different matrices are used the dwell period of the printing pad 22 on the matrix 32 and the required pressure are always the same. The cam disc 36 which is disposed in the region opposite the print carrier 37 and causes the printing pad 22 to be pressed onto the print carrier 37 comprises one of the shapes of FIG. *6a* to *6c* dependently upon the surface character and the shape of the print carrier 37. The construction of the cam disc 36 as a normal eccentric disc corresponding to the disc *36a* in FIG. *6a* serves for attaining a medium standstill period and a medium specific pressure. If in contrast a relatively long standstill period is to be attained, because such long period is required by the special surface character of the print carrier 37 because the ink is not absorbed so quickly by the print carrier 37 and if a medium specific pressure is to be attained the cam disc 36 corresponding to the disc *36b* in FIG. *6b* has the shape of a flattened eccentric disc. The flattening is constructed as a circular arc the center of which is the hexagonal shaft 41. In dependence upon the required standstill period and the required pressure the flattening may be more or less severe. The flattening is disposed in this case in the region of the cam disc 36 most remote from the hexagonal shaft 41. If, however, the maximum value of the pressure is to disappear quickly or the printing pad 22 must be lifted quickly off the print carrier 37, the cam disc 36 is constructed in accordance with disc *36c* in FIG. *6c* in the form of an ovoid eccentric disc. The point of the ovoid eccentric disc 36 is disposed in this case in the region of the cam disc 36 most remote from the hexagonal shaft 41. The hexagonal shaft 41 which is rotatably mounted in the region of its two ends in casing walls is provided at its one end with a bevel wheel 44 which is in engagement with a bevel wheel 45 which in turn is connected by a sprocket wheel disposed on the shaft of the bevel wheel 45 and a chain 46 to a further sprocket wheel 47. A gear wheel 48 which engages in gear wheel segments 49 is located on the same axis with the sprocket wheel 47. The gear wheel segments 49 are located diametrally relatively to each other on the driving disc 12, and in respect to the roller 13 located on the driving disc 12, they are disposed in such manner that the gear wheel segments 49 come into engagement with the gear wheel 48 only as long as the lever 15 is at rest in one of its two end positions, i.e. as long as the roller 13 of the driving disc 12 rolls along the enlargement 17 of the slot guide 14 and thus the carriage 26 also is at rest in its respective end position.

Furthermore, a second carriage 50 is guided on the bars 27 and is driven by a guide member 51 which is pivotally connected to an arm 52. The one end of the arm 52 is pivotally connected to a pin 53 rigidly attached to the apparatus casing, and the other end of the arm 52 comprises a guide slot 54 into which engages a pin 55 which is fixed to the lever 15 outside the plane of the slot guide 14.

A holder member 56 is fixed to the carriage 50 and a brush 57 is vertically displaceable therein by means of a key and keyway connection. The brush 57 which serves for depositing and distributing the ink on the matrix 32 dips in its lower position into an ink container 58 which is arranged on a table 59 adjacent to the matrix 32. The brush 57 is fixed to the lower end of a holder member 61 provided with a clamping device 60, the upper end of the holder member being attached to tie rods 62 which are guided in the carriage 50 on both sides of the bars 27 and which are held by springs 63 in their position turned towards the ink container 58. The upper ends of the tie rods 62 are pivotally connected to arms 64 which are mounted, such as by a key and keyway, at their ends remote from the tie rods on a shaft 65 which is rotatably mounted on an extension 66 of the carriage 50. Furthermore an arm 67 which is disposed parallel to the arms 64 is rigidly attached to the shaft 65 and supports at its end remote from the shaft 65 a roller 68 which projects laterally from the arm 67; the roller 68 is disposed below the longitudinal axis of the arm 67 and, as illustrated in FIG. 4, cooperates with a cam member 69 which is attached to the machine casing and is displaceable in the direction of movement of the carriage 50. The cam member 69 comprises a cam surface 104 and a guide surface 105. When at the end of the movement of the carriage 50 in the direction of the arrow 101 the roller 68 impinges on the cam surface 104 of the cam member 69 the arm 67 and thus also the tie rods 62 are lifted against the action of the springs 63 so that the brush 57 is also lifted at the end of the movement during which it brushes over the matrix 32. The carriage 50, however, moves a short distance further in the same direction. Thereby the heap of ink which is pushed in front of the brush 57 remains on the matrix 32 or in a groove located therebeyond, and during the return movement in the direction of the arrow 102, the brush engages behind the ridge or heap of ink because at the end of the movement, the cam member 69 and the arm 67 and thus the brush 57 are moved downwardly under the effect of the springs 63 acting on the tie rods 62 and the roller 68 then rolls along the lower guide surface 105 during the movement in the direction of the arrow 102. During the return movement the excess ink is then moved back into the ink container 58 because the brush 57 again brushes over the matrix 32.

Furthermore, a carrier 106, which is diagrammatically illustrated in FIGS. 5*a–c* and 8, for the doctor blade 83 is pivotally mounted on the holder member 56. The carrier member 106 has an angular portion 70 on which a rail 71 is mounted which is pivotal about a pin 72 and which is fixable in its pivotal position. For this purpose the rail 71 is provided with an adjusting and clamping screw 73 which is guided in a guide slot 74 of the angular portion 70. Slots 76 are provided in the rail 71 in which clamping screws 77 are guided in which a member 75 provided with a dovetail guide 81 is attached to the rail 71. So that the position of the member 75 fitted with the dovetail guide 81 can be adjusted relatively to the rail 71, eyes 78 having screw-threaded openings are provided in which adjusting screws 79 are guided to the lower ends of which lips 80 of the member 75 are rotatably but not axially displaceably attached. A clamping device 82 which supports the doctor blade 83 is displaceably guided in the dovetail guide 81 of the member 75. The dovetail guide 81 merely serves the purpose to permit quick interchange of the doctor blade 83. Rods 84 are pivotally connected to the angular portion 70 which are also longitudinally displaceable in the carriage 50 on both sides of the bars 27 and which are pressed downwardly by springs 85, that is to say into the position in which the doctor blade 83 can scrape the excess ink off the matrix 32. The rods 84 are pivotally connected at their upper end remote from the angular portion 70 to arms 87 which are rigidly attached to a common shaft 88 which is rotatably mounted in the extension 66 of the carriage 50. Furthermore, an arm 89 which extends substantially parallel to the arms 87 is rigidly mounted on the shaft 88 and a roller 90 is rotatably mounted at the end of the arm 89 remote from the shaft 88 as illustrated in FIGS. 5*a–c*, the roller 90 cooperating with two cam surfaces 91 and 92 disposed on the machine casing at the ends of the horizontal stroke movement of the carriage 50. The cam surfaces 91 and 92 are adjustable and displaceable in the direction of movement of the carriage 50. The cam faces 91 and 92 permit the doctor blade 83 to slide over the matrix 32 only in the one direction of movement, i.e. after the ink has been deposited on the matrix 32. At the end of this movement the cam surface 92 causes the doctor blade 83 to be lifted off the surface of the matrix 32. Thereupon a detent device ensures that during the return movement, the doctor blade 83 runs back above the matrix 32 in the raised position. When the cam surface 91 is reached the detent device is released so that the doctor blade 83 moves downwardly again and smoothly contacts the matrix 32.

As illustrated in FIGS.5*a–c*, the detent device comprises a pivotal lever 93 which is pivotally mounted about a pin 94 which is attached to the extension 66 of the carriage 50. The end of the pivotal lever 93 remote from the roller 90 of the arm 89 carries a roller 95 which cooperates with an abutment 96 and runs upon the latter, the abutment being attached to the cam surface 91 and extending below the cam surface 91 at a spacing therefrom and parallel thereto. During the movement in which the doctor blade 83 travels in the raised position at a spacing above the matrix 32, that is to say during the movement in the direction of the arrow 101, a pin 100, which is attached to the arm 89 and which forms at the same time the axis of the roller 90, rests on a T-shaped intermediate member 98 mounted on the pivotal lever 93, the arm 89 being in a horizontal position and the pivotal lever 93 being in a vertical position. The intermediate member 98 which is also pivotal about the pin 94 is connected to the pivotal lever 93 by a coil spring 103 such that the intermediate member 98 is always pulled against an abutment edge 97 of the pivotal lever 93. When during the movement of the carriage 50 in the direction of the arrow 101 the roller 90 of the arm 89 travels upon the cam surface 91 and the roller 95 of the pivotal lever 93 travels upon the abutment 96, first the arm 89 is pivoted upwardly and then the pivotal lever 93 is pivoted, in the clockwise direction against the effect of a coil spring 99 disposed between the pin 94 and the pivotal lever 93 as illustrated in FIGS. 5*a–c*. Thereby, the abutment-edge 97 of the pivotal lever 93 displaces the intermediate member 98 in such manner that the pin 100 is no longer supported. When then the roller 95 of the pivotal lever 93 leaves the abutment 96 in the direction of the arrow 102, the lever 93 rotates back into the starting position owing to the effect of the spring 99, but the intermediate member 98 cannot return into the position in which it supports the pin 100 because the latter has moved downwardly in the meantime since the roller 90 rolls on the cam surface 91. As the spring 99 has a greater tension force than the spring 103, the pivotal lever 93 is rotated back into its original vertical position and the intermediate member remains pivoted into an oblique position relatively to the pivotal lever 93. The pin 100 lies then directly on the upper edge of the pivotal lever 93 and the doctor blade 83 assumes a position in which it can scrape ink off the matrix 32 during the movement in the direction of the arrow 102. At the end of the movement of the carriage 50 in the direction of the arrow 102, the roller 90 of the arm 89 rolls upon the cam surface 92 so that the pin 100 is lifted off the upper edge of the pivotal lever 93 and the intermediate member 98 moves again into contact with the abutment edge 97 of the pivotal lever 93 owing to the effect of the spring 103. When the roller 90 of the arm 89 leaves the cam surface 92 again in the opposite direction, that is to say in the direction of the arrow 101, the arm 89 is lowered until the pin 100 engages the intermediate member 98 so that the doctor blade 83 assumes again its raised position. The doctor blade 83 remains in its raised position until the rollers 90 or 95 impinge again upon the cam surface 91 or the abutment 96 and the doctor blade 83 moves down again during the movement in the direction of the arrow 102 in the manner described above.

As FIG. 1 illustrates further, a base plate 108 in which the matrix 32 is fixed is adjustable longitudinally and transversely and is fixable on the table 59. Moreover, the base plate 108 is displaceable on the table 59 by means of a spindle which is rotatable by means of a hand wheel 109.

In the position of the driving disc 12 illustrated in FIG. 1, the brush 57 and the doctor blade 83 as well as the printing pad 22 are in their rest positions. In this case, the brush 57 is dipped into the ink container 59, the doctor blade 83 is in its raised position between the ink container 57 and the matrix 32 owing to the cam surface 92 located at this rest point, and the printing pad 22 is in the raised position exactly above the matrix 32. The gear wheel 48 for the drive of the cam discs 35 and 36 is just still in engagement with the toothed segment 49 disposed opposite the roller 13 of the driving disc 12 namely for such period until the roller 13 leaves the enlargement 17 of the slot guide 14. When the disc then rotates in the direction of the arrow 107, that is to say in the clockwise direction, the gear wheel 48 is disengaged from the toothed segment 49 when the roller 13 has arrived at the end of the enlargement 17, at which instant of time the point of the cam disc 35 which is disposed at the smallest spacing from the hexagonal shaft 41 lies opposite the roller 34 of the plunger 29. When then the roller 13 engages into the upper part of the slot guide 14 the carriage 26 starts moving in the direction of the arrow 101 and because of the play of the pin 55 of the lever 15 in the guide slot 54 of the lever 52 the carriage 50 begins to move a little later, also in the direction of the arrow 101. Thereby, the brush 15 slides over the matrix 32 and wets it with ink. The two carriages 26 and 50 move in the direction of the arrow 101 until the roller 13 of the driving disc 12 emerges from the upper part of the slot guide 14 and engages into the enlargement 17. The carriages 26 and 50 have attained their second rest position. This occurs after a rotation of approximately 80° of the driving disc 12 in the direction of the arrow 107, i.e. when the roller 13 is in a position in which it is located approximately symmetrically to its starting position illustrated in FIG. 1 with respect to the vertical axis of the driving disc 12. In this position the printing pad 22 is located accurately above the print carrier 37, the brush 57 which had been raised at the end of the matrix 32 owing to the cam member 69 shortly prior to attaining the enlargement 17 is lowered again and, viewed in the direction of the arrow 102, is then located in front of the matrix 32, and the doctor blade 83 is still in its raised position approximately between the matrix 32 and the print carrier 37; however, owing to the cam surface 91 and the abutment 96 the detent device which has held the doctor blade 83 in the raised position during the movement in the direction of the arrow 101 is already disengaged. When the driving disc 12 rotates further in the direction of the arrow 107, the roller 13 rolls along the enlargement 17 while the toothed segment 49 of the driving disc 12 adjacent to the roller 13 comes into engagement with the gear wheel 48 so that the hexagonal shaft 41 is rotated and the cam disc 36 comes into engagement with the roller 34 of the plunger 29, whereby the plunger is slowly depressed until the point of the cam disc 36 having the largest spacing from the hexagonal shaft rests on the roller 34 of the plunger 29. Thereupon the plunger 29 is raised and thus the printing pad 22 is slowly removed again from the print carrier 37. When the roller 13 of the driving disc 12 is disposed at the transition from the enlargement 17 to the lower part of the slot guide 14 as illustrated in FIG. 3 by a broken line, the gear wheel 48 is disengaged again from the toothed segment 49 adjacent to the roller 13; the cam discs 35 and 36 are located again in their original position and the printing pad 22 had again been completely lifted off the print carrier 37. During further movement of the driving disc 12 in the direction of the arrow 107, the roller 13 engages into the lower part of the slot guide 14, whereupon the two carriages 26 and 50 move in the direction of the arrow 102. The brush 57 slides thereby over the matrix 32 and pushes the excess ink into the ink container 58; the doctor blade 83 also slides over the matrix 32 and scrapes off the excess ink so that the ink is located only in the etched-in grooves. When the roller 13 enters from the lower part of the slot guide 14 into the enlargement 17, the two carriages 26 and 50 have attained again their original first rest position. The brush 57 hangs thus again in the ink container 58, the doctor blade 83 which has been raised again at the end of the matrix 32 owing to the cam surface 92 is located between the ink container 57 and the matrix 32, and the printing pad 22 is located exactly opposite the matrix 32. When then the roller 13 rolls further along the enlargement 17 the gear wheel 48 comes into engagement with the toothed segment 49 disposed opposite the roller 13 so that the hexagonal shaft 41 starts rotating again. Thereby the cam disc 35 engages the roller 33, presses the printing pad 22 slowly against the matrix 32 and lifts it off again. This process takes place until the roller 13 has attained the starting position illustrated in FIG. 1. The printing pad 22 has thus accepted ink again from the matrix 32, and, as described already, is then moved again towards the print carrier 37 and pressed upon the latter while the brush 57 again deposits ink on the matrix 32.

The apparatus according to the invention furthermore comprises a feed device (not illustrated) for the print carrier 37. If, for example, a plurality of similar print carriers are printed with the same pattern or marking the print carriers 37 may be supplied automatically by means of such feed device to the table on which the print carriers 37 come to rest. Removal of the printed print carriers 37 may also be effected automatically by means of a delivery device not illustrated. In this manner, considerably more print carriers 37 can be imprinted per unit time with the apparatus according to the invention so that a mass production is possible.

FIG. 7 illustrates diagrammatically another embodiment of the invention in plan view. In this case a matrix 110, a print carrier 111, a second matrix 112 and a second print carrier 113 are arranged in a circle. Four printing pads 115 are arranged on a rotary cross 114 which is rotatable in 90° steps in the operating rhythm of the machine. The rotary cross performs a reciprocating stroke movement which is at right angles to the plane of the drawing during the standstill of its rotary movement and the printing pads 115 are pressed onto the matrices 110, 112, or the print carriers 111, 113, respectively, at the lower dead point of the movement. While thus the one printing pad receives ink, the other printing pad delivers the ink to the respective print carrier. Thereby a multiplication of the output of the machine is obtained.

The printing method according to the invention and the machine according to the invention are particularly suitable for printing concave and convex surfaces. Furthermore, in contrast to the known screen printing method tubes and the like can be printed also on the inside, in which case the printing pad is in the form of a pin or stem.

I claim:

1. Apparatus for printing materials comprising a table for an ink container, a matrix, a print carrier, a brush for inking the matrix, a doctor blade and at least one printing pad having an ink repellent surface which permits ink to adhere thereto when the pad is pressed onto the matrix with a predetermined pressure, the printing pad being disposed on a plunger and arranged for movement between the matrix and the print carrier which is spaced therefrom, the printing pad having a rest position arranged above at least one of the matrix and the print carrier and being movable in the direction of one of the matrix and the print carrier for contact therewith, the brush and the doctor blade being arranged for movement over and engagement with the matrix, at least one of the plunger and the brush and the doctor blade being secured to movable carriages disposed in a guide means, and means connecting said brush, said doctor blade and said plunger via said carriages to a common drive for coordinating the movements thereof, said common drive being in the form of a motor driven disc, the disc being provided at a point about its periphery with a roller engaging a guide of a lever, the lever being pivotally mounted on a first pin secured to a casing of the apparatus, the lever being pivotally connected to the carriages by connecting members, the guide of the lever being constructed at its two ends as a slot guide and having in its central portion an outwardly extending bulge constituting a portion of the periphery of a circle along the circumference of which the roller of the disc travels during a portion of its movement so as to maintain the printing pad in contact with one of the matrix and the print carrier for a predetermined period.

2. Apparatus according to claim 1, wherein the member connected to the printing pad carriage is displaceably mounted in a sleeve which is pivotally connected to one end of the lever remote from the first pin, the member being connected to the sleeve by means of a compression spring and a tension spring.

3. Apparatus according to claim 1, wherein the member connected to one of the brush and the doctor blade carriage is pivotally connected to an arm which is pivotal about a second pin rigidly attached to the apparatus casing, the arm being provided at its end remote from the second pin with a guide slot which engages with a third pin disposed on the lever.

4. Apparatus according to claim 1, wherein the plunger for the printing pad is spring loaded and arranged for engagement with cam discs driven by the motor driven disc for controlling the stroke movement of the plunger and the associated printing pad.

5. Apparatus according to claim 4, wherein the cam discs are of different cam shapes and are mutually interchangeable.

6. Apparatus according to claim 4, wherein the plunger supporting the printing pad is provided with two rollers at its end cooperating with the cam discs, which rollers roll along the cam discs during the stroke movement of the printing pad and which are adjustable independently of each other.

7. Apparatus according to claim 6, wherein the cam discs, the rollers and the plunger cooperate to press the printing pad onto at least one of the matrix and the print carrier with a pressure of approximately 3 $kp/cm^2$.

8. Apparatus according to claim 6, wherein the spacing of the rollers from the printing pad is adjustable.

9. Apparatus according to claim 1, wherein the disc is provided with teeth in two diametrically oppositely disposed segments into which a gear wheel which is in operative connection with the cam discs engages when the roller of the disc rolls along the bulge portion of the guide of the lever.

10. Apparatus according to claim 9, wherein the brush and the doctor blade are arranged to be adjustable in height.

11. Apparatus according to claim 10, wherein the brush is disposed on a spring loaded tie rod means which is guided for movement in the carriage for the brush, the tie rod means being adapted to be moved into engagement with a stationary cam member disposed at the end point of movement for the carriage.

12. Apparatus according to claim 11, wherein the cam member is adjustable in the direction of movement of the carriage.

13. Apparatus according to claim 11, wherein the tie rod means includes a tie rod pivotally connected to a first arm which is pivotally connected to the carriage for the brush, and a second arm which is provided with a roller cooperating with the cam member being connected to the first arm such that the movement of the second arm is transferred to the first arm and the tie rod.

14. Apparatus according to claim 11, wherein the cam member comprises a cam surface which is disposed in a path travelled through by the roller during the forward movement of the carriage and which is arranged to lift the roller, and wherein the cam member comprises a second cam surface which is disposed in a path travelled through by the roller during the return movement of the carriage and which arranged to deflect the roller downwardly out of the region of the cam surface.

15. Apparatus according to claim 10, wherein the doctor blade is disposed on a spring loaded tie rod means which is guided for movement in the carriage for the doctor blade, the tie rod means cooperating with stationary cam surfaces disposed at the end point of movement for the carriage.

16. Apparatus according to claim 15, wherein the cam surfaces are adjustable in the direction of movement of the carriage.

17. Apparatus according to claim 15, wherein the tie rod means includes a tie rod pivotally connected to a first arm which is pivotally connected to the carriage for the doctor blade, and a second arm which is provided with a roller cooperating with the cam surfaces being connected to the first arm such that the movement of the second arm is transferred to the first arm and the tie rod.

18. Apparatus according to claim 15, wherein the second arm carrying the roller is provided with a detent device which is disposed on the carriage and which is adapted to detain the roller and thus the doctor blade in a raised position, and wherein an abutment is disposed in the path of the detent device which is idly movable in the one direction of movement and which releases the detent device in the other direction of movement.

19. Apparatus according to claim 18, wherein the detent device is provided with a lever which is pivotal against spring action about a pin, the end of which lever adjacent to the second arm supports an intermediate member which is pivotal against spring effect about the pin and end of which remote from the arm supports a roller in the path of which the stationary abutment in the vicinity of the end point of movement of the carriage for the doctor blade is disposed and wherein the lever is tightly engaged with the intermediate member during the pivotal movement in which it releases the detent.

* * * * *